US009482019B2

(12) United States Patent
Fontana

(10) Patent No.: US 9,482,019 B2
(45) Date of Patent: Nov. 1, 2016

(54) LEVELING DEVICE FOR LAYING TILES OR THE LIKE

(71) Applicant: Simone Fontana, Vicenza (IT)

(72) Inventor: Simone Fontana, Vicenza (IT)

(73) Assignee: PROFILITEC S.P.A. SOCIO UNICO, Torri di Quartesolo (VI) (IT)

( * ) Notice: Subject to any disclaimer, the term of this patent is extended or adjusted under 35 U.S.C. 154(b) by 0 days.

(21) Appl. No.: 14/659,748

(22) Filed: Mar. 17, 2015

(65) Prior Publication Data

US 2015/0267420 A1 Sep. 24, 2015

(30) Foreign Application Priority Data

Mar. 18, 2014 (IT) ..... VI2014A0059

(51) Int. Cl.

| | |
|---|---|
| ***E04F 21/22*** | (2006.01) |
| ***E04F 13/08*** | (2006.01) |
| ***E04F 15/02*** | (2006.01) |
| ***E04F 21/00*** | (2006.01) |
| ***E04F 21/18*** | (2006.01) |

(52) U.S. Cl.

CPC ..... *E04F 21/22* (2013.01); *E04F 13/0892* (2013.01); *E04F 15/02022* (2013.01); *E04F 21/0092* (2013.01); *E04F 21/1877* (2013.01)

(58) Field of Classification Search

CPC ..... E04F 15/02005; E04F 15/02022; E04F 15/02027; E04F 15/02452; E04F 15/02464; E04F 15/0247; E04F 15/02476; E04F 21/0092; E04F 21/1877; E04F 21/22; E04F 13/0892

USPC ..... 52/126.1, 126.5, 126.6, 126.7, 122.1, 52/389–392, 220.1, 749.11, DIG. 1; 33/526, 527

See application file for complete search history.

(56) References Cited

U.S. PATENT DOCUMENTS

| | | | | |
|---|---|---|---|---|
| 4,888,922 | A * | 12/1989 | Lancelot | E04G 15/04 249/217 |
| 4,991,365 | A * | 2/1991 | Jackson | A47B 91/024 160/135 |
| 5,333,423 | A * | 8/1994 | Propst | E04F 15/02476 248/188 |
| 6,704,972 | B2 * | 3/2004 | Pyle | B65D 63/1072 24/16 PB |
| 7,257,926 | B1 * | 8/2007 | Kirby | E04F 15/02005 33/526 |

(Continued)

FOREIGN PATENT DOCUMENTS

| | | | | |
|---|---|---|---|---|
| AU | WO 2014022889 | A1 * | 2/2014 | E04F 21/0092 |
| EP | 2241702 | A2 | 10/2010 | |

(Continued)

*Primary Examiner* — Joshua J Michener
*Assistant Examiner* — Theodore Adamos
(74) *Attorney, Agent, or Firm* — Themis Law

(57) ABSTRACT

A leveling device for laying tiles or the like includes a tie-rod having a support base for edge portions of one or more adjacent tiles, a projecting element from the base, which can be arranged into junctions between adjacent tiles, and a knob coupling with the projecting element and having an outlet pass-through hole for a free end of the projecting element. The knob is configured to force an edge portion of the adjacent tiles against the base to level the placement and is configured to receive and retain, by snap coupling elements, a blocking tie-rod hooking and retaining the projecting element inside a pass-through channel defined in the blocking tie-rod. The blocking tie-rod is sectioned into two coupling half-shells, embracing and constraining the projecting element when inserted in the cap, and mutually separating to leave free the projecting element when at least partially extracted from the cap.

7 Claims, 3 Drawing Sheets

(56) References Cited

U.S. PATENT DOCUMENTS

| | | | | |
|---|---|---|---|---|
| 8,079,199 | B1 * | 12/2011 | Kufner | E04F 13/0892 33/526 |
| 2006/0185319 | A1 * | 8/2006 | Kufner | E04F 13/0892 52/749.11 |
| 2010/0263304 | A1 * | 10/2010 | Torrents I Comas | E04F 21/0092 52/126.5 |
| 2010/0287868 | A1 * | 11/2010 | Kufner | E04F 15/02005 52/391 |
| 2010/0314418 | A1 * | 12/2010 | Roth | B65D 41/26 222/205 |
| 2013/0067854 | A1 * | 3/2013 | Bordin | E04F 21/0092 52/749.11 |
| 2013/0255182 | A1 * | 10/2013 | Kufner | E04F 21/00 52/749.11 |
| 2014/0033641 | A1 * | 2/2014 | Trevisi | E04F 21/0092 52/749.1 |
| 2015/0027082 | A1 * | 1/2015 | Hoffman | E04F 21/0092 52/749.11 |
| 2015/0184355 | A1 * | 7/2015 | Wang | E02D 35/005 52/126.1 |
| 2015/0211243 | A1 * | 7/2015 | Irvine | E04F 21/0092 52/126.1 |

FOREIGN PATENT DOCUMENTS

| | | | |
|---|---|---|---|
| EP | 2549030 | A2 | 1/2013 |
| EP | 2573296 | A1 | 3/2013 |

* cited by examiner

LEVELING DEVICE FOR LAYING TILES OR THE LIKE

FIELD OF THE INVENTION

The present invention is generally applicable to the technical field of the construction industry and, in particular, relates to equipment for working on floors or walls.

More in detail, the present invention relates to equipment for tiling or similar.

BACKGROUND OF THE INVENTION

In the construction industry, a relevant aspect is the finishing of the internal or external locations. Such details, in fact, are very important not only from a functional point of view, but also from an aesthetic one.

To this aim, floors and walls are often covered with tiles, i.e. with architectural elements able to properly finish the surfaces and also to provide a good looking impression to the location.

For laying tiles, a layer of adhesive material is typically applied, on which they are placed. The tiles are typically leveled by striking them on various points of their surface with an hammer.

It is evident that such approach is not only operationally time-consuming, but also requires great skill and hardly ever ensures optimal results. Generally, in fact, the tiles laid in this manner are not perfectly coplanar, not only because of the laying technique, but also because the solidification of the adhesive material may induce small movements that causes a loss of planarity.

Therefore, special devices are known to assist the user when laying tiles. In particular, such devices comprise a tie-rod and a load element attached thereto. The tie-rod typically consists of a base that is disposed on the glue and on which the edges of adjacent tiles are placed, and a projecting element that emerges from the tile plan through the joints. The load element, which presses the edge of the tiles to the wall, is coupled to said projecting element. The use of a high number of such devices with their correct adjustment allows acting on several points of each of the laid tiles, ensuring a perfect coplanarity of the same even after solidification of the adhesive.

Subsequently, it is sufficient to remove the load element and to disconnect the element projecting from the base. This operation is facilitated by providing a weakened point between the base and the projecting element.

According to a first known embodiment, the projecting element is constituted of a plate-like body provided with a cracking above the level of the tiles, on which a wedge is placed constituting the load element. However, this embodiment is expensive because a different tie-rod for each different tile thickness must be provided. Furthermore, the detachment of the projecting element is not always easy.

Devices are also known where the projecting element is constituted of a plate-like body provided with a toothed rack and the load element is constituted of a knob provided with a pass-through hole suitable to be crossed by the projecting element and molded to interact with the rack, so as to prevent the pulling of the projecting element. The adjustment of the pressure of the load element, therefore, can be easily obtained by pressing down the knob.

With said embodiment, the detachment of the projecting element is easy with the support of the knob. The knob can also be recovered, but this can only occur by removing the remaining part of the projecting element and this is not always easily achievable. In fact, this operation can only be performed from the detachment side of the projecting element from the base and the portion protruding from the knob could be particularly low.

Another drawback is that the pressure adjustment is not very easy since it is only possible to increase pressure and not to decrease it due to the interaction between the rack and the knob.

For these reasons, an additional type of device has been realized where the projecting element is constituted by a pivot at least partially threaded, and the knob comprises a female thread portion for adjusting the pressure. In this case the adjustment can be improved both by screwing and unscrewing and the detachment of the projecting element from the base is nevertheless assisted by the knob.

However, the recovery of the knob remains difficult because the installer is forced to unscrew from the knob the projecting element detached from the base. Since typically the number of such devices is particularly high in use, it is evident that the operation is particularly costly in terms of both execution time and physical energy.

SUMMARY OF THE INVENTION

An object of the present invention is to at least partially overcome the above mentioned drawbacks by providing a leveling device for laying tiles or the like, which allows optimizing the laying operation and obtaining a substantially coplanar surface.

Another object of the present invention is to provide a leveling device that is easy to use and which allows, therefore, an easy adjustment of the arrangement of the tiles.

A further object is providing a device that allows an easy and safe removal from the tiled surface.

Another object is providing a device that allows maintaining low laying costs by enabling the recycling of most of the its components.

A further object is to optimize costs in terms of time and effort to carry out such recycling.

These objects, and others which will appear more clearly hereinafter, are fulfilled by a leveling device for laying tiles or the like according to the invention.

In particular, the device comprises at least a tie-rod having a support base for the edge portions of one or more adjacent tiles, and a projecting element from the base which may be arranged into the junctions between the tiles. It also comprises at least one knob configured to be coupled to the projecting element and having an outlet pass-through hole for the free end of the latter. Moreover, the knob is capable of forcing at least one portion of the edge of the adjacent tiles against the base to level them.

According to an aspect of the invention, the knob comprises at least one cap having the aforementioned outlet hole and capable to hook and retain detachably, by snap coupling elements, a blocking tie-rod susceptible to hook and retain the projecting element inside a pass-through channel.

According to another aspect of the invention, the blocking tie-rod is sectioned into at least two half-shells configured to reciprocally couple, embracing and hooking the projecting element, when inserted into the cap, and to decouple, leaving free the projecting element, when at least partially extracted from the cap.

In other words, the knob is composed of two components reciprocally coupled by means of snap coupling elements, the cap and the blocking tie-rod. The latter plays its function when inserted into the cap, while it releases the tie-rod when extracted at least partially from the cap. At that point, in fact, the two half-shells holding the tie-rod can be separated by withdrawing the constraint.

Advantageously, the use of the knob is simplified, since it is sufficient to set up the two half-shells to embrace the projecting element and subsequently to bring the cap until it surrounds them.

After solidification of the glue, the recovery of the knob is also advantageously simplified. It is sufficient, in fact, to cause the detachment from the base of the projecting element with the knob and then remove the blocking tie-rod from the cap. The two half-shells that compose the blocking tie-rod will then be free to separate by releasing the projecting element. The blocking tie-rod and the cap are therefore reusable.

Since both the half-shells and the cap can be made by plastic molding, the costs of production are contained.

BRIEF DESCRIPTION OF THE DRAWINGS

Further features and advantages of the invention will appear more evident upon reading the detailed description of some not-exclusive embodiments of a leveling device for laying tiles according to the invention, which are described as non limiting examples with the help of the enclosed drawings, in which.

DETAILED DESCRIPTION OF EMBODIMENTS OF THE INVENTION

Figure 1:
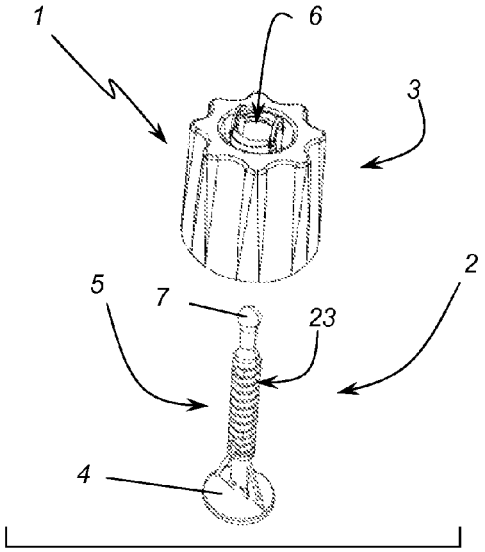
FIG. 1 illustrates a leveling device according to the invention in a partially exploded axonometric view.
Figure 2:
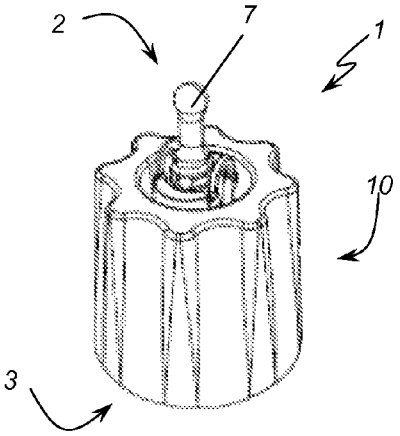
FIG. 2 illustrates the device of FIG. 1 in an axonometric view.

With reference to the figures, and in particular to FIGS. 1 and 2, an embodiment of a leveling device 1 according to the invention for laying tiles is described herein.

The device 1 comprises, like similar known devices, a tie-rod 2 and a knob 3.

In particular, the tie-rod 2 comprises a support base 4 to be disposed over an adhesive and to receive and support the edge portions of the tiles. It also comprises a projecting element 5 from the base 4 susceptible to be arranged into the junctions between adjacent tiles that rest on the base 4.

With regard to the knob 3, it can be coupled to the projecting element 5 and it has a pass-through hole 6 for the output of the free end 7 of the projecting element 5. As it is known, the knob 3 forces at least one portion of the edge of adjacent tiles against the base 4 to level the tiles being laid.

Figure 3:
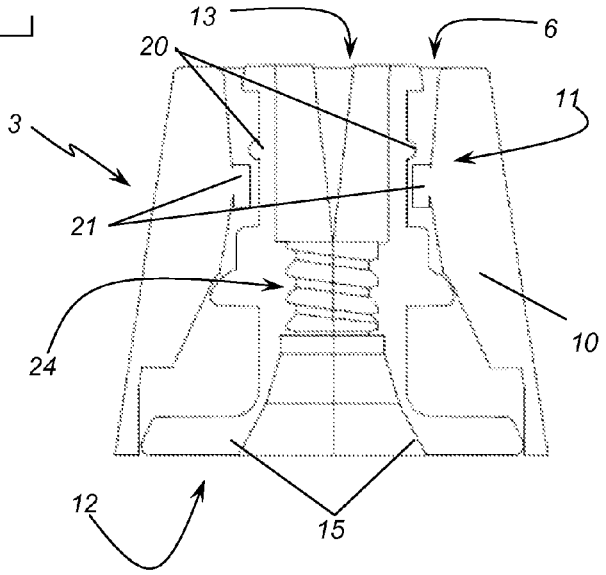
FIGS. 3-5 illustrate details of the leveling device of FIG. 1.
Figure 4:
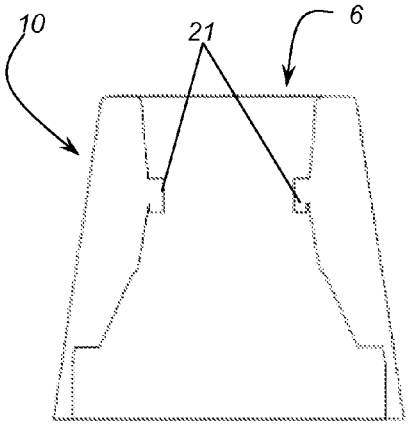

According to an aspect of the invention, the knob 3 comprises, as it can be observed in the details of FIGS. 3 and 4, a cap 10 in which said pass-through hole 6 is formed and which is suitable to receive and to detachably retain, with snap coupling elements 11, a blocking tie-rod 12, whose primary function is to hook and retain the projecting element 5. This hooking action occurs within a pass-through channel 13 present in the blocking tie-rod 12 and ending into the pass-through hole 6.

Figure 5:
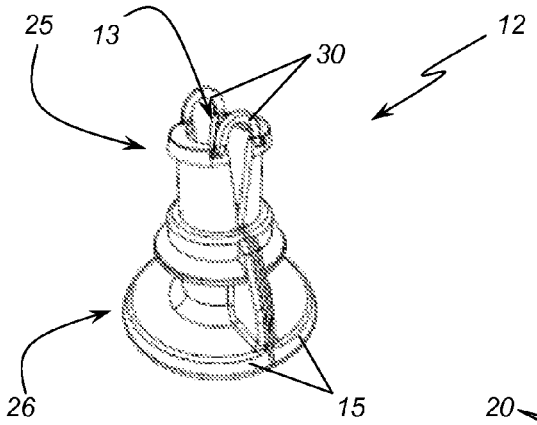
Figure 6:
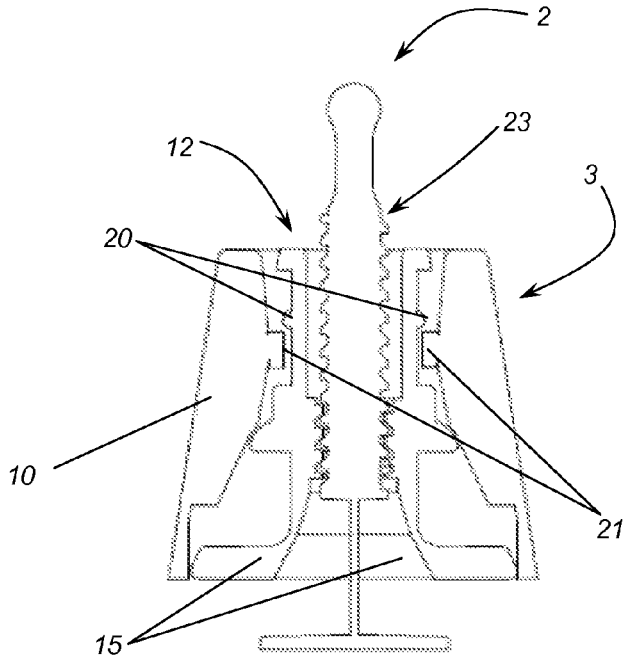
FIG. 6 illustrates the leveling device of FIG. 1 in a sectioned view.

According to another aspect of the invention, the blocking tie-rod 12, as it can be observed in FIG. 5, is sectioned into two half-shells 15 that reciprocally couple by embracing and hooking, as it is also observed in FIG. 6, the projecting element 5 when inserted in the cap 10. The half-shells 15 are free to separate when extracted at least partially from the cap 10, disengaging the projecting element 5. In other words, the cap 10 keeps the two half-shells 15 coupled to form the locking tie-rod 12 so that, when the latter is extracted from the cap 10, the coupling is lost.

As mentioned above, it is evident that use of the knob 3 is facilitated. After arranging the adhesive, the tie-rods 2 on the adhesive and of the tiles, it is sufficient to arrange the two half-shells 15 embracing the projecting element 5 of the tie-rod 2 by supporting their lower ends on the tiles and then by placing them in the cap 10, which keeps them well coupled. The device 1 is then in its operative position with the projecting element 5 that protrudes from the knob 3 in correspondence to the pass-through hole 6.

The removal operation of the device 1 is also facilitated. It is sufficient to force the knob 3, after the adhesive has hardened, to cause the detachment of the projecting element 5 from the base 4. Subsequently, the separation of the projecting element 5 from the knob 3 is simplified since it is sufficient to exert a force on the free end 7 of the projecting element 5 to trigger the snap coupling elements 11 to release the blocking tie-rod 12 from the cap 10. This procedure allows the two half shells 15 to separate by releasing the projecting element 5.

It will be appreciated that the number of the half-shells composing the blocking tie-rod is a non-limiting feature for the invention. In fact, this blocking tie-rod can be constituted of any number of half-shells greater than two without departing from the scope of the invention.

Figure 7:
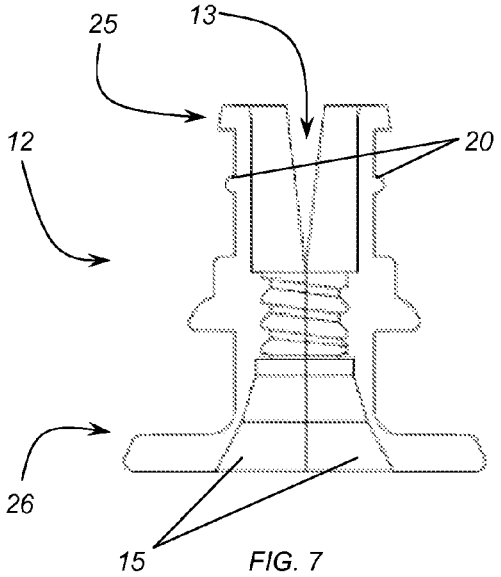

With regard to the snap coupling elements 11, they comprise, as it can be observed with the aid of FIG. 7, a projection 20 lateral to the blocking tie-rod 12 interacting with a collar 21 internally projecting to the cap 10. Typically, the lateral projection 20 is constituted of a tooth, but even this feature is not to be considered limiting the invention. In different embodiments, in fact, the projection may itself be constituted of a shaped collar or, according to other embodiments, the collar is made on the lateral surface of the tie-rod and the protrusion is formed on the inner surface of the cap. In other embodiments, the projections are in a number higher than one.

As mentioned, the projecting element 5 of the tie-rod 2 is held, or hooked, by the blocking tie-rod 12 when the device 1 is in an operative configuration. Such hooking action is carried out by a thread 23, which is defined on the projecting element 5 and which interacts with a female screw portion 24 made in the channel 13 of the blocking tie-rod 12. This shape allows adjusting the pressure exerted by the knob 3 on the tiles. In fact, after assembly of the half-shells 15 around the tie-rod 2 and their insertion into the cap 10, the pressure exerted by the knob 3 is adjusted by screwing it on the tie-rod 2. If the tightening action is excessive, it is sufficient to proceed in the opposite direction.

Even this feature of the present embodiment is not to be considered limiting in view of different embodiments of the present invention.

For example, in another embodiment, the constraint is obtained by one or more projections on the lateral surface of the projecting element and a contrast tooth protruding from the inner surface of the channel. In particular, the protrusions of the projecting element may constitute a rack, upon which the tooth in the channel acts conversely. Even in this case, the extraction of the blocking tie-rod from the cap enables the half-shells to separate with the consequent detachment of the tooth from the rack.

Figure 8:
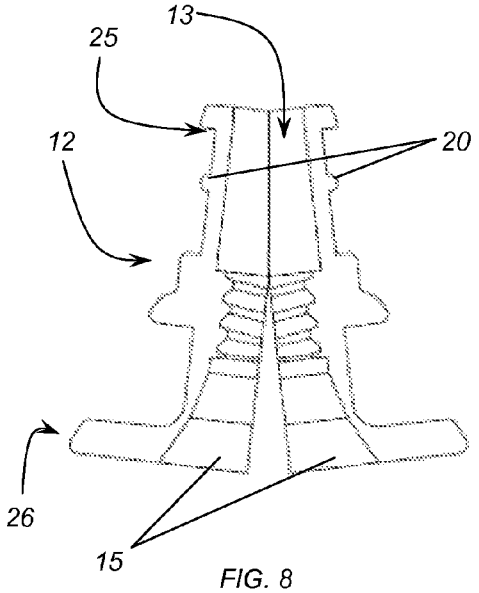

As previously mentioned, the release of the projecting element 5 can also take place with a partial extraction of the blocking tie-rod 12 from the cap 10. However, to do that a separation between the half-shells 15 is required. In order to ease such separation, facilitating also the extraction of the blocking tie-rod 12 from the inside of the cap 10, the half-shells 15 have a shape, as it can be observed in particular in FIG. 5, that allows their oscillation with respect to the plane of mutual contact. In particular, this oscillation enables the two half-shells 15 to achieve at least two coupling positions:

a first position, visible in FIG. 7, in which first ends 25 facing each other are in contact, while the second ends 26 are spread apart;

a second position, visible in FIG. 8, in which the first ends 25 are spread apart and the second ends 26 are in contact.

In this way, the above described stress applied on the free end 7 of the projecting element 5 to obtain the output of the blocking tie-rod 12 from the cap 10 is eased, since the action of the snap coupling elements 11 is attenuated by the oscillatory movement between the two half-shells 15, which causes the first ends 25 to approach and to move in mutual contact and the second ends 26 to spread apart.

Figure 9:
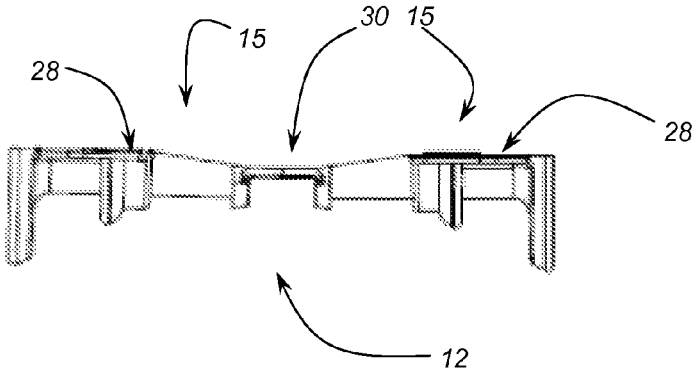
FIGS. 7 to 9 illustrates additional details of the leveling device of FIG. 1.

From the figures, and in particular from FIG. 9, it can be observed that in the described embodiment the oscillatory motion is obtained by shaping the contact surfaces 28 between the half-shells 15 at least partially curved, i.e., not lying in a single plane. Obviously, this feature is not to be considered limiting for different embodiments. For example, in a possible embodiment, the contact surfaces identify, in profile, a broken line.

Figure 10:
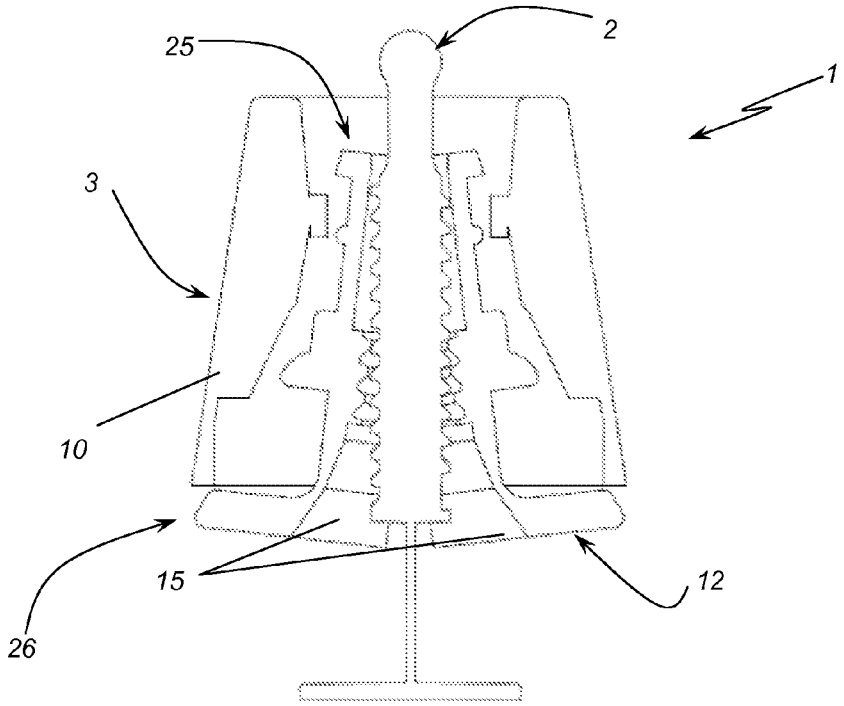
FIG. 10 illustrates the leveling device of FIG. 1 in an operating mode and in a sectioned view.

With such a configuration, the stress applied on the free end 7 of the projecting element 5 causes the above mentioned oscillation that, as shown in FIG. 10, causes the opening of the second ends 26, favoring the release of the projecting element 5.

According to another aspect of the invention, in order to simplify the task of the installer during assembly and disassembly of the device 1, the first ends 25 of the half-shells 15 are mutually connected through hinges 30. In this way, the two half-shells 15 are maintained close to one another.

In view of the foregoing, it can be appreciated that a leveling device according to the invention overcomes the drawbacks of the prior art while maintaining low execution costs, since a part of its components can be recycled. This recycling operation, however, requires less time and effort for the installer compared to what is required in the above described known art.

A device according to the invention still allows optimizing tile laying, obtaining a surface that is substantially coplanar. It is easy to use and provides for easy adjustment of the arrangement of different tiles. Also, its removal from the tiled surface is easy and safe.

A leveling device according to the invention is susceptible to numerous modifications and variations, all falling within the inventive concept expressed in the enclosed claims. All the described components may be replaced by other technically equivalent components, and the materials may be different according to requirements without departing from the scope of the invention.

Although a leveling device according to the invention has been described with particular reference to the enclosed figures, reference numbers used in the description and in the claims are used to improve the intelligence of the invention and are not to be considered limiting the claimed scope.

The invention claimed is:

1. A leveling device for laying tiles comprising:

a tie-rod (2) having a support base (4) for edge portions of one or more adjacent tiles and a projecting element (5) from said support base (4), configured to be arranged in junctions between the adjacent tiles; and a knob (3) configured to be coupled to said projecting element (5) and having an outlet pass-through hole (6) for a free end (7) of said projecting element (5), said knob (3) forcing at least the edge portions of the adjacent tiles against said base (4), thereby leveling the tiles, wherein said knob (3) comprises at least one cap (10) having said outlet pass-through hole (6) and configured to receive and retain in an interior of said cap (10), by snap coupling elements (11) located in the interior of said cap, a blocking tie-rod (12), hooking and retaining said projecting element (5) inside a pass-through channel (13) defined in said blocking tie-rod (12), and wherein said blocking tie-rod (12) is sectioned into at least two half-shells (15), each of said at least two half-shells comprising a first end, said first ends (25) of said half-shells (15) are coupled to one another by hinges (30), said half-shells being configured to mutually couple by coming in at least partial contact with each other, thereby embracing and constraining said projecting element (5) when said blocking tie-rod (12) is inserted in said cap (10), and to separate, thereby freeing said projecting element (5) when said blocking tie-rod (12) is at least partially extracted from said cap (10).

2. The leveling device according to claim 1, wherein said snap coupling elements (11) comprise at least one protrusion (20) extending laterally from said blocking tie-rod (12) and configured to interact with a collar (21) protruding from an inner wall of said cap (10).

3. The leveling device according to claim 1, wherein said projecting element (5) is constrained in said blocking tie-rod (12) by a thread (23) formed on said projecting element (5) and a mating female portion (24) provided in said channel (13).

4. The leveling device according to claim 1, wherein said projecting element (5) is constrained in said blocking tie-rod by one or more protrusions formed on a lateral surface of said projecting element and at least one tooth projecting from an inner surface of said channel.

5. The leveling device according to claim 4, wherein said protrusions are shaped as a rack.

6. A leveling device for laying tiles comprising:

a tie-rod (2) having a support base (4) for edge portions of one or more adjacent tiles and a projecting element (5) from said support base (4), configured to be arranged in junctions between the adjacent tiles; and a knob (3) configured to be coupled to said projecting element (5) and having an outlet pass-through hole (6) for a free end (7) of said projecting element (5), said knob (3) forcing at least the edge portions of the adjacent tiles against said base (4), thereby leveling the tiles, wherein said knob (3) comprises at least one cap (10) having said outlet pass-through hole (6) and configured to receive and retain in an interior of said cap (10), by snap coupling elements (11) located in the interior of said cap, a blocking tie-rod (12), hooking and retaining said projecting element (5) inside a pass-through channel (13) defined in said blocking tie-rod (12), wherein said blocking tie-rod (12) is sectioned into at least two half-shells (15), said half-shells being configured to mutually couple by coming in at least partial contact with each other, thereby embracing and constraining said projecting element (5) when inserted in said cap (10), and to separate, thereby freeing said projecting element (5) when at least partially extracted from said cap (10), wherein said half-shells (15) are shaped to allow an oscillation of said half-shells with respect to a plane of mutual contact, said oscillation allowing said two half-shells (15) to assume two coupling positions selected from the group consisting of:

a first position, in which first ends (25) facing each other of said half-shells (15) are in contact while second ends (26) are spread apart; and a second position, in which said first ends (25) of said half-shells (15) are spread apart and said second ends (26) are in contact.

7. The leveling device according to claim 6, wherein said first ends (25) of said half-shells (15) are coupled to one another by hinges (30).

* * * * *